US008171981B2

(12) United States Patent
Graham et al.

(10) Patent No.: US 8,171,981 B2
(45) Date of Patent: May 8, 2012

(54) METHOD OF CASTING METAL ARTICLES

(75) Inventors: Lawrence D. Graham, Chagrin Falls, OH (US); Robert M. Garlock, Chardon, OH (US); Gary J. Vanek, Chardon, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 596 days.

(21) Appl. No.: 12/273,998

(22) Filed: Nov. 19, 2008

(65) Prior Publication Data

US 2011/0108230 A1 May 12, 2011

(51) Int. Cl.
*B22D 27/04* (2006.01)

(52) U.S. Cl. ..... 164/122.1; 164/338.1

(58) Field of Classification Search ..... 164/122, 164/122.1, 122.2, 125, 338.1
See application file for complete search history.

(56) References Cited

U.S. PATENT DOCUMENTS 3,763,926 A 10/1973 Tschinkel et al.
4,190,094 A 2/1980 Giamei
6,308,767 B1 * 10/2001 Hugo et al. ..... 164/122.1
6,354,360 B1 * 3/2002 Betz et al. ..... 164/122.1
6,446,700 B1 9/2002 Klug
6,776,213 B2 8/2004 Graham et al.

FOREIGN PATENT DOCUMENTS

DE 42 16 870 C2 8/1994

* cited by examiner

*Primary Examiner* — Kevin P Kerns
(74) *Attorney, Agent, or Firm* — Tarolli, Sundheim, Covell & Tummino LLP

(57) ABSTRACT

During casting of metal articles, a mold is moved into a body or bath of molten metal. The mold is moved into a container which contains a portion of the body of molten metal. Heat is transferred at a first rate from the mold to a first portion of the body of molten metal disposed above the container. Heat is transferred at a second rate from the mold to the second portion of the body of molten metal at least part of which is disposed in the container. The container retards movement of molten metal relative to the mold to effect an increase in the temperature of the molten metal in the container and thereby retards transfer of heat from a portion of the mold disposed in the container to the body of molten metal. The mold enters the container through an opening at the upper end portion of the container. One or more additional openings may be provided at the lower end portion of the container.

21 Claims, 5 Drawing Sheets

METHOD OF CASTING METAL ARTICLES

BACKGROUND OF THE INVENTION

The present invention relates to the cooling of molten metal in a mold with a body or bath of molten metal which is at a lower temperature than the molten metal in the mold.

It has previously been suggested that a casting apparatus may employ a body of molten metal as a bath to promote directional solidification of an article in a mold. One apparatus for doing this is disclosed in U.S. Pat. No. 6,308,767.

During use of this known apparatus, as a portion of the mold enters the body or bath of molten metal, solidification of the molten metal in the mold is initiated by a relatively high rate of heat transfer from the mold to the upper portion of the body of molten metal. As the mold continues to move downward in the body or bath of molten metal, heat continues to be removed from the metal in the mold at a relatively high rate. This high rate of heat removal can result in excessive stressing of metal in the mold due to differential thermal contraction. These stresses can result in cracking of an article cast in the mold.

SUMMARY OF THE INVENTION

The present invention relates to a new and improved method of casting metal articles. The method includes moving a mold containing a first molten metal downward into a body or bath of a second molten metal. As the mold enters the body of molten metal, heat is transferred at a first rate from the mold to a first portion of the body of molten metal.

As the mold moves downward into the body of molten metal, the mold may enter a container in which a portion of the body of molten metal is disposed. The container is effective to retard movement of molten metal in the body of molten metal relative to the mold. This results in the temperature of the portion of the body of molten metal disposed in the container increasing to thereby retard transfer of heat from the portion of the mold disposed in the container to the body of molten metal. Retarding the transfer of heat from the portion of the mold disposed in the container to the body or bath of molten metal minimizes stress formation in metal solidified in the mold.

The present invention has a plurality of different features which are advantageously utilized together in the manner disclosed herein. However, it is contemplated that the features may be utilized separately and/or in combination with features from the prior art.

BRIEF DESCRIPTION OF THE DRAWINGS

The foregoing and other features of the invention will become more apparent upon a consideration of the following description taken in connection with the accompanying drawings wherein.

DESCRIPTION OF SPECIFICPREFERRED EMBODIMENTS OF THE INVENTION

General Description

Figure 1:
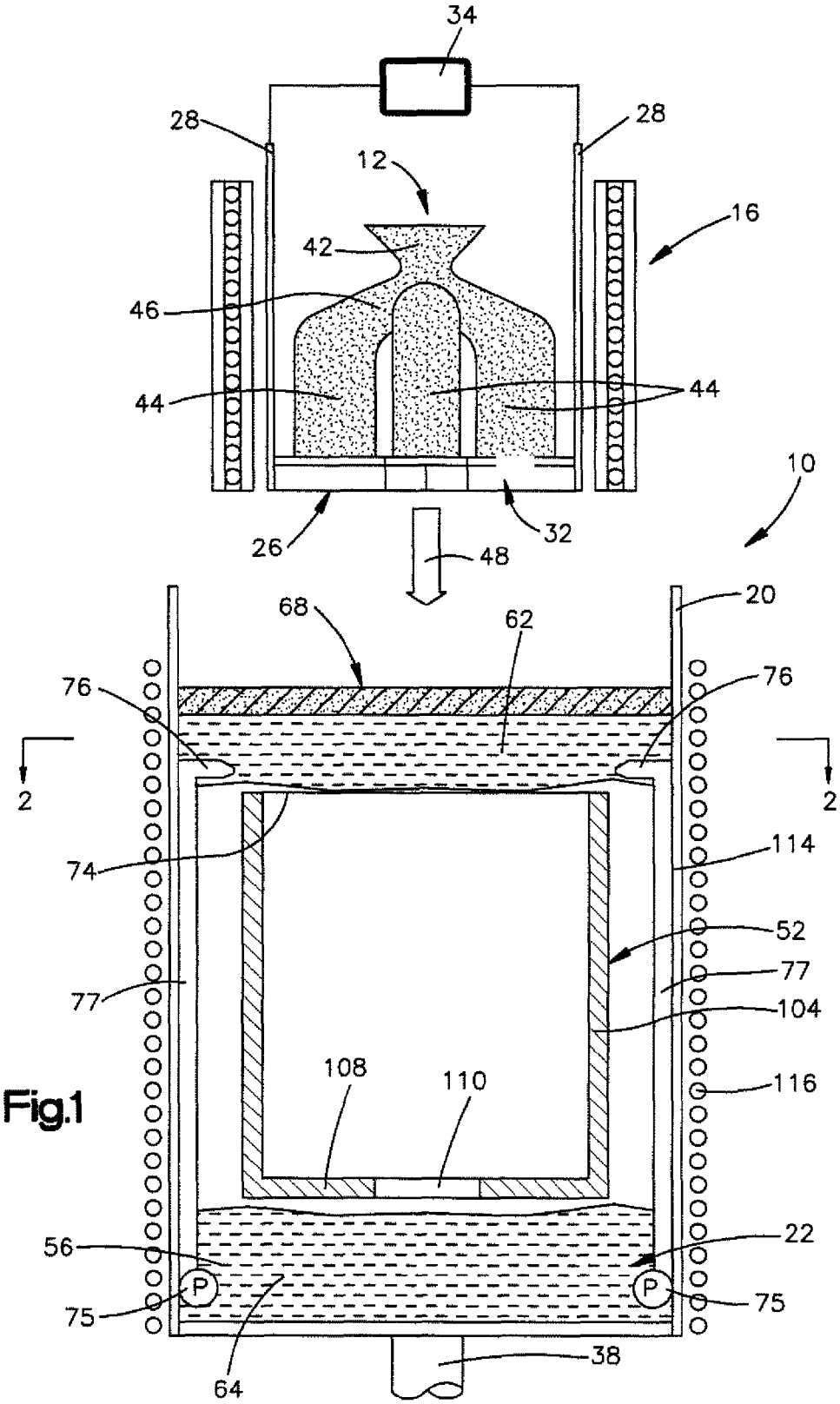
FIG. 1 is a partially broken away schematic illustration depicting the relationship between a furnace assembly in which a first molten metal is poured into a mold, a tank which is disposed beneath the furnace assembly and holds a body or bath of a second molten metal, and a container which is disposed in the body of molten metal.

A casting apparatus 10 is illustrated schematically in FIG. 1 and is utilized in an improved method of casting metal articles in a mold structure 12. The casting apparatus 10 includes a furnace assembly 16 in which a first molten metal is poured into this ceramic mold structure 12 in a known manner. Directly beneath the furnace assembly 16 is a tank 20 which holds a bath or body 22 of a second molten (liquid) metal. It should be understood that the body 22 of a second molten metal substantially fills the cylindrical tank 20. However, the body 22 of a second molten metal has been broken away in FIG. 1 for purposes of clarity of illustration.

The casting apparatus 10 is enclosed by a suitable housing (not shown) which is connected with a source of vacuum or low pressure and with a source of inert gas by conduits. This housing enables an inert atmosphere to be maintained around the furnace assembly 16 and tank 20 holding the body 22 of molten metal. The housing may have any one of many known constructions, including the construction disclosed in U.S. Pat. No. 3,841,384 and/or the construction shown in U.S. Pat. No. 6,308,767. Of course, the housing may have a construction which is different than the known constructions illustrated in the aforementioned patents.

A framework 26 (FIG. 1) is provided to support the mold 12 for movement to and from the furnace assembly 16 and for movement to and from the body 22 of molten metal. The metal framework 26 includes a plurality of parallel support rods 28 and a mold support structure 32. The mold support structure 32 functions as, and may be referred to as, a chill plate.

The support rods 28 are connected with an upper drive assembly 34 and with the mold support structure 32. The upper drive assembly 34 is operable to raise and lower the mold support framework 26 relative to the furnace assembly 16 and tank 20 holding the body 22 of molten metal. If desired, the support rods 28 may be disposed outside the furnace assembly 16.

The mold support framework 22 has a construction which is the same as is disclosed in U.S. patent application Ser. No. 12/145,033 filed Jun. 24, 2008 by Robert M. Garlock and entitled Method of Casting Metal Articles. The disclosure in the aforementioned application Ser. No. 12/145,033 is hereby incorporated herein in its entirety by this reference thereto. Of course, the mold support and framework may have a different construction if desired. For example, the mold support and framework 26 may have a construction similar to a construction disclosed in U.S. Pat. No. 6,308,767.

A lower drive assembly 38 (FIG. 1) is connected with the tank 20 which holds the body 22 of molten metal. The lower drive assembly 38 is operable to raise and lower the tank 20 relative to the furnace assembly 16. The upper and lower drive assemblies 34 and 38 may be operated simultaneously and/or sequentially to raise and/or lower the framework 26 and/or container 20 holding the body 22 of molten metal.

During operation of the casting apparatus 10, the one piece ceramic mold structure 12 is supported in the furnace assembly 16 by the framework 26. The mold structure 12 is disposed on the support structure 32 forming the base of the framework 26. The mold structure 12 may be connected to the support structure 32 by suitable clamps and/or fasteners.

Heat is transmitted from the mold structure 12 to the metal support structure 32 which functions as a chill plate. The mold structure 12 is raised and lower relative to the furnace assembly 16 by operation of the upper drive assembly 34 which is connected to the support structure 32 by the support rods 28. If desired, a flow of cooling liquid may be conducted through the support structure 32. It is contemplated that the support structure may be constructed so as to be located outside of the furnace assembly 16.

While the mold structure 12 is supported in the furnace assembly 16 on the framework 26, the manner illustrated schematically in FIG. 1, the mold structure is preheated to a desired temperature. Molten metal is poured into a pour cup 42 which is connected with article molds 44 in the mold structure 12 by a gating system 46. The illustrated mold structure 12 is of a one-piece ceramic construction. However, the mold structure may be formed by two or more pieces and may have a construction other than a ceramic construction.

The mold structure 12 has a construction which is similar to the construction disclosed in U.S. Pat. Nos. 5,048,591; 5,062,468; and/or 5,072,771. The mold structure 12 is utilized to cast turbine engine components. However, it should be understood that the mold structure 12 may have a construction which is different than the construction which is disclosed in the aforementioned patents and/or may be used to cast articles other than turbine engine components.

The mold structure 12 is filled with molten metal while the mold structure is in the furnace assembly 16. The metal with which the mold structure is filled is a molten nickel-chrome super alloy which melts at a temperature which is greater than 3,000 degrees Fahrenheit. Of course, the mold structure 12 may be filled with a different molten metal which melts at a different temperature. For example, the mold structure 12 may be filled with molten titanium or a titanium alloy.

Once the mold structure 12 has been filled with the molten nickel-chrome super alloy metal, the upper drive assembly 34 is operated to lower the mold support framework 26, in the manner indicated by the arrow 48 in FIG. 1. As the mold structure 12 is lowered, it moves into the body 22 of a second molten (liquid) metal in the tank 20. While the upper drive assembly 34 is operated to lower the mold structure 12, the lower drive assembly 38 may be operated to raise the body 22 of molten metal.

It should be understood that the mold structure 12 may be immersed in the body 22 of molten (liquid) metal by lowering the support structure 32 without raising the body 22 molten metal. Alternatively, the furnace assembly 16 may be raised relative to the mold structure 12 and the body 22 of molten metal raised relative to the mold structure to immerse the mold structure in the body of molten metal. Either one or both of the mold structure 12 and body 22 of molten metal may be moved relative to the other to effect immersion of the mold structure 12 in the body 22 of molten metal.

The molten super alloy in the mold structure 12 is at a temperature above 3,000 degrees Fahrenheit. The bath or body 22 of molten metal is at a temperature below 1,000 degrees Fahrenheit. The resulting temperature differential between the molten metal in the mold structure 12 and the molten metal in the body 22 of molten metal results in directional solidification of the molten metal in the mold structure 12 as the mold structure is immersed in the bath or body 22 of molten metal. The molten metal in the mold structure 12 may solidify with either a columnar grain crystallographic structure or with a single crystal crystallographic structure.

In the illustrated embodiment of the invention, the bath or body 22 of molten metal is formed of tin and is at a temperature for approximately 500 degrees Fahrenheit. However, the bath or body 22 of molten metal may be formed of lead or aluminum if desired. The molten metal in the mold structure 12 is a nickel-chrome super alloy with a melting temperature which may be approximately 3,700 degrees Fahrenheit. Of course, a different molten metal may be poured into the mold structure 12. In addition, a different molten metal may be utilized in the bath or body 22 of molten metal.

It should be understood that the specific temperatures for the bath or body 22 of molten metal and the molten metal in the mold structure 12 will vary depending upon the composition of the metal. For example, the bath or body 22 of molten metal may be any one of many metals which is liquid (molten) at a temperature of 1,500 degrees Fahrenheit. The molten metal in the mold structure 12 may be any one of many different metals which melt at a temperature above 2,000 degrees Fahrenheit.

The greater the temperature differential between the temperature of the molten metal in the mold structure 12 and the bath or body 22 of molten metal, the greater will be the rate heat is withdrawn from the molten metal in the mold structure as the mold structure is immersed in the bath or body of molten metal. Of course, the rate of heat transfer from the molten metal in the mold structure 12 to the bath or body 22 of molten metal will also vary as a function of the rate at which the mold structure and body or bath of molten metal are moved relative to each other by the upper and/or lower drive assemblies 34 and 38.

Container

In accordance with one of the features of the present invention, a container 52 (FIG. 1) is provided within the tank 20. The container 52 contains a portion of the molten metal forming the bath or body 22 of molten metal. Thus, a first portion 56 of the body of molten metal is disposed outside of the container 52. A second portion 58 (FIG. 2) of the body 22 of molten metal is disposed within the container 52. Although the second portion 58 of the body or bath 22 of molten metal has not been illustrated in FIG. 1, the bath or body 22 of molten metal fills the container 52.

Figure 2:
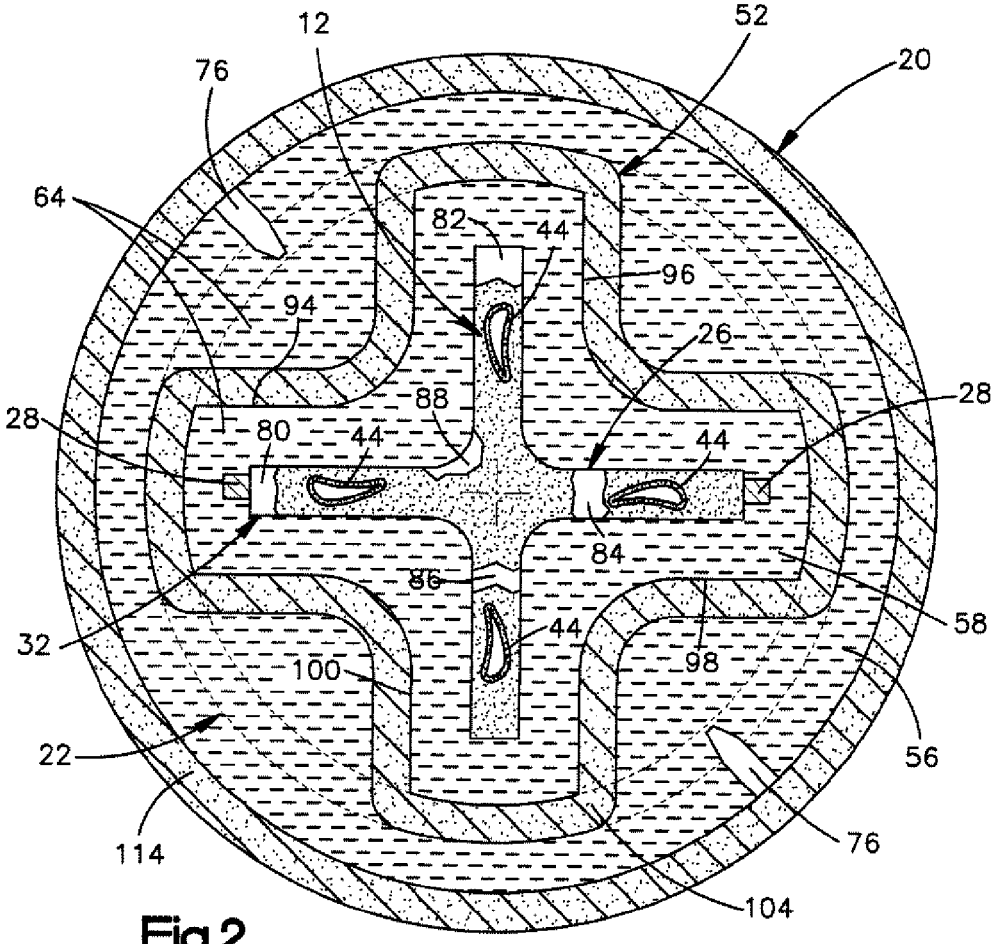
FIG. 2 is an enlarged schematic plan view, taken generally along the line 2-2 of FIG. 1, further illustrating the relationship between the tank, the container which is disposed in the body of molten metal, and the mold which is at least partially disposed in the container.

The container 52 is submerged in the bath or body 22 of molten metal. Therefore, the upper portion 62 (FIG. 1) of the bath or body of molten metal 22 is disposed above the container 52. Similarly, a lower portion 64 of the bath or body 22 of molten metal extends around, fills, and is disposed below the container 52 (FIGS. 1 and 2). The container 52 is fixedly connected to the tank 20 by suitable supports (not shown) which extend between the tank 20 and container 52.

After the mold structure 12 (FIG. 1) has been filled with molten metal, while the mold structure is in the furnace assembly 16, the mold structure is lowered into the bath or body 22 of molten metal. As this occurs, the mold support framework 26 is lowered through a layer 68 of insulating material which floats on the bath or body 22 of molten metal. As the mold structure 12 is lowered, lower end portions of the article molds 44 move downward into the upper portion 62 of the bath or body 22 of molten metal.

The bath or body 22 of molten metal is at a substantially lower temperature than the molten metal in the article mold cavities in the mold structure 12. This results in a relatively high rate of heat transfer from the lower portions of the article molds 44 to the upper portion 62 of the body 22 of molten metal. This relatively high rate of heat transfer is effective to initiate solidification of the molten metal in the article molds 44 as the mold structure 12 moves downward. As the mold structure 12 moves slowly downward in the upper portion 62 of the bath or body 22 of molten metal, initial solidification of the molten metal in the lower end portions of the article molds 44 is substantially completed.

Continued downward movement of the mold support framework 26 and mold structure 12 results in the mold support framework 26 moving through an opening 74 (FIG. 1) at the upper end of the container 52. The container 22 is completely immersed in the body 22 of molten metal.

As the mold support structure 32 moves through the opening 74 at the upper end portion of the container 52, the liquid molten metal 58 (FIG. 2) in the container is displaced by the mold support structure and the mold structure 12. A portion of the displaced molten metal 58 is forced upwardly. Another portion of the displaced molten metal 58 is forced downwardly. Therefore, as the mold support structure 32 and mold structure 12 move into the container 52, molten metal moves both upwardly and downwardly from the container.

As the mold support framework 26 continues to be lowered, the lower end portions of the article molds 44 move through the upper opening 74 into the container 52. As the mold support framework 26 continues to move downward into the container 52, the mold structure 12 continues to move into the upper portion 62 of the bath or body 22 of molten metal and to move into the container 52. Due to the relatively high rate of heat transfer from the mold structure 12 as it moves downward through the upper portion 62 of the bath or body 22 of molten metal, solidification of the molten metal in the mold structure is initiated as the mold structure moves through the upper portion 62 of the bath or body 22.

The rate of heat transfer from the mold structure 12 is reduced when the mold structure moves into the container 52. This is because the container 52 retards movement of the portion of the bath 22 disposed in the container relative to the mold structure 12. Therefore, heat which is transferred from the mold structure 12 to the portion 58 of the body 22 of molten metal disposed in the container 52 results in a heating of the portion of the body of molten which is disposed in the container and engages the mold structure. This heating of the portion 58 of the body of molten metal is effective to reduce the rate of heat transfer from the mold structure to the body 22 of molten metal.

The high rate of heat transfer from the mold structure to the upper portion 62 of the bath 22 is desirable to initiate directional solidification of the molten metal in the mold structure. The relatively low rate of heat transfer from the mold structure 12 to the portion of the body 22 disposed in the container 52 is desirable to avoid stress in castings formed in the article molds 44. If heat is transferred from the portion of the mold structure 12 disposed in the container 52 at the same rate at which heat is transferred from the portion of the mold structure to the upper portion 62 of the body of molten metal, different thermal contraction causes stress in the cast articles in the mold structure. This stress may be sufficient to cause cracking of the cast article in the mold structure 12.

The portion of the bath 22 disposed outside of the container 52 is free to move in the tank 20. However, the portion of the bath 22 disposed within the container 52 is restrained against movement relative to the mold structure 12. This results in the portion 58 of the bath 22 disposed in the container 52 being somewhat stagnate around the portion of the mold structure 12 disposed in the container 52.

The temperature of the stagnate portion 58 of the bath 22 disposed in the container 52 quickly increases due to heat transfer from the mold structure 12. As the temperature of the portion of the bath 22 disposed within the container 52 increases, the rate of heat transfer from the mold structure 12 is reduced. The resulting reduction in the rate of heat transfer from the mold structure 12 minimizes the formation of stresses in castings formed in the article molds 44.

The volume of the portion 58 of the bath or body 22 of molten metal disposed in the container 52 decreases as the mold support framework 26 and mold structure 12 move into the container 52. The decrease in the volume of molten metal 22 remaining in the container 52 facilitates raising the temperature of molten metal 58 in the container by heat transmitted from the portion of the mold structure 12 disposed in the container. As the temperature of the molten metal 58 in the container 52 rises, the rate of heat transfer from the mold structure 12 decreases. Decreasing the rate of heat transfer from the mold structure 12 reduces the tendency for stresses to be formed in articles cost in the mold structure.

Circulation

The container 52 retards circulation of the portion of the body 22 of molten metal in the container 52. This results in a reduction in the rate of heat transfer from the portion of the mold structure disposed in the container 52. In order to increase the rate of heat transfer from the portion of the mold structure 12 disposed in the upper portion 62 of the body 22 of molten metal, circulation of the molten metal in the upper portion 62 is promoted.

To promote circulation of molten metal in the upper portion 62 of the body 22 of molten metal, pumps 75 are connected with nozzles 76 by conduits 77. Fluid flow from the pumps 75 is discharged from the nozzles 76 into the upper portion 62 of the body 22 of molten metal. This fluid flow promotes movement of the molten metal in the upper portion 62 of the body 22 of molten metal around the portion of the mold structure 12 disposed in the upper portion of the body of molten metal. By promoting movement of molten metal in the upper portion 62 of the body 22 of molten metal, heat transfer from the portion of the mold structure 12 engaged by the upper portion of the body of molten metal is promoted.

In the embodiment of the invention illustrated in FIGS. 1 and 2, the pumps 75 and the conduits 77 are disposed inside the tank 20. However, the pumps 75 and/or conduits 77 may be disposed outside the tank 20 if desired. Of course, the pumps 75, nozzles 76 and conduits 77 may be omitted if desired.

It is contemplated that the upper portion 62 of the body 22 of molten metal may be maintained at a lower temperature than the portion 58 of the body of molten metal disposed in the container 52 in ways other than the use of the pumps 75 and conduits 77. For example, cooling coils may be provided in association with the upper portion of the tank 20. Alternatively, a flow of relatively cool molten metal may be provided to the upper portion 62 of the body 22 of molten metal. Of course heating coils may be provided in association with the container 52.

Mold Support Structure

In the illustrated embodiment of the invention, the mold support structure 32 (FIG. 2) has a generally X-shaped configuration. Thus, the mold support structure 32 includes support sections 80, 82, 84, and 86. The support sections 80 and 84 have coincident longitudinal central axes. The support sections 82 and 86 have coincident longitudinal central axes which extend perpendicular to the longitudinal central axes of the support sections 80 and 84. The support sections 80-86 have rectangular cross sectional configurations as viewed in planes extending perpendicular to the longitudinal axes of the support sections.

The support sections 80-86 are interconnected at a central portion 88 (FIG. 2) of the support structure 32. The support structure 32 may be integrally formed from one piece of material. Alternatively, the support structure 32 may be formed from a plurality of separate pieces of material which are interconnected by the central portion 88 of the support structure. The support structure 32 is formed of 304 stainless steel. However, the support structure 32 may be formed of a different material if desired. For example, the support structure 32 may be formed of a ceramic material.

Although the illustrated embodiment of the support structure 32 includes four support structures 80-86, it should be understood that the support structure may have a greater or lesser number of support sections if desired. It should also be understood that although the support sections 80-86 extend at right angles to adjacent support sections, a different angle may be provided between the support sections if desired. The support sections 80-86 may have a different configuration from the illustrated configuration.

Although only two support rods 28 are illustrated as being connected to the support sections 80 and 84, additional support rods may be connected with the support sections 82 and 86 if desired. The support structure 32 has the same construction as is disclosed in U.S. patent application Ser. No. 12/145,033 filed Jun 24, 2008 by Robert M. Garlock and entitled Method of Casting Metal Articles. The disclosure in the aforementioned application has been and is hereby incorporated herein in its entirety by this reference thereto.

The container 52 (FIG. 2) has an upper opening 74 with the same configuration as the configuration of the mold support structure 32. Thus, the upper opening 74 has a generally X-shaped configuration. The upper opening 74 includes arms 94, 96, 98 and 100 in which the support sections 80-86 of the mold support structure 32 are received (FIG. 2).

The container 52 has a vertically extending sidewall 104 which has the same cross sectional configuration, throughout its axial extent, as the upper opening 74. The illustrated sidewall 104 is free of openings. However, the sidewall 104 may have one or more openings if desired.

The container 52 also has a bottom wall 108 (FIG. 1) which extends inwardly from the sidewall 104 of the container. The bottom wall 108 has a circular lower opening 110. The lower opening 110 facilitates movement of molten metal forming the bath 22 out of the container 52 as the mold support framework 26 and mold structure 12 are lowered into the container. If desired, the lower opening 110 may have a different configuration. For example, the opening 110 may have an X-shaped configuration. It should be understood that the bottom wall 108 and opening 110 may be omitted if desired.

The container 52 may be supported by supports extending from the bottom wall 108 of the container 52 to the bottom of the tank 20. If desired, additional container supports may extend between the sidewall 104 of the container 52 and the sidewall 114 of the tank 20.

The mold support framework 26 and mold structure 12 are slowly lowered into the container 52 by the upper drive assembly 34 to minimize disturbance of the molten metal forming the bath or body 22. Of course, as the mold support framework 26 and mold structure 12 are moved into the bath or body 22 of molten metal, the level of the bath rises in the tank 20. The tank 20 has a cylindrical sidewall 114 with sufficient height to retain the bath or body 22 of molten metal as the mold support framework 26 and the mold structure 12 are lowered into the bath 22. A heating coil 116 extends around the tank 20 and is energized to maintain the bath or body 22 of molten metal at a desired temperature. If desired, a cooling coil may also extend around the upper portion of the tank to assist in maintaining the upper portion 62 of the body 22 of molten metal at a desired temperature during lowering of the mold structure 12 into the body of molten metal.

When the mold support framework 26 and mold structure 12 are lowered into the submerged container 52, a portion of the molten metal 58 in the container flows out of the container. The molten metal flows upwardly between the framework 26 and the sidewall 104 of the container 52. The molten metal also flows upwardly between the mold structure 12 and the sidewall 104 of the container 52. This upward flow of molten metal leaves the container 52 through the opening 74 at the upper end of the container. The molten metal flows downward along the sidewall 104 and central portion of the container 52 to the bottom wall 108. The molten metal 58 flows along the bottom wall and through the lower opening 110 into the portion 56 of the molten metal disposed outside of the container 52.

The resulting reduction in the amount of molten metal 22 in the container 52 facilitates heating of the molten metal in the container to a temperature which is greater than the temperature of the upper portion 62 of the molten metal 22 in the tank 20. Once a portion of the framework 26 and a portion of the mold structure 12 have been lowered into the container 52, heat is transmitted from the mold structure to the molten metal remaining in the container. As the temperature of the molten remaining in the container 52 increases, the rate of transmission of heat from the mold structure 12 is reduced. This reduces any tendency for stresses to form in the articles cast in the mold structure 12.

In the embodiment of the invention illustrated in FIGS. 1 and 2, the mold support structure 32 has a generally X-shaped configuration (as viewed in FIG. 2). However, it is contemplated that the mold support structure 32 may have a different configuration if desired. For example, the mold support structure 32 may have a circular configuration. Alternatively, the mold support structure 32 may have a polygonal configuration.

The container 52 has an X-shaped cross sectional configuration (as viewed in FIG. 2) which corresponds to the configuration of the mold support structure 32. However, it is contemplated that the container 52 may have a different cross sectional configuration if desired. For example, the container 52 may have a circular cross sectional configuration. Alternatively, the container 52 may have a polygonal cross sectional configuration. Although it may be desired to have the cross sectional configuration of the container 52 correspond to the configuration of the support structure 32, as shown in FIG. 2, it is contemplated that the cross sectional configuration of the container 52 may be different than the configuration of the support structure.

It is contemplated that the lower opening 110 (FIG. 1) will be sized to obtain a desired rate of flow of molten metal 58 from the container 52 as the mold support framework 26 and mold structure 12 are lowered into the container 52. The larger the opening 110, the lower its resistance to flow of molten metal from the container 52.

Figure 3:
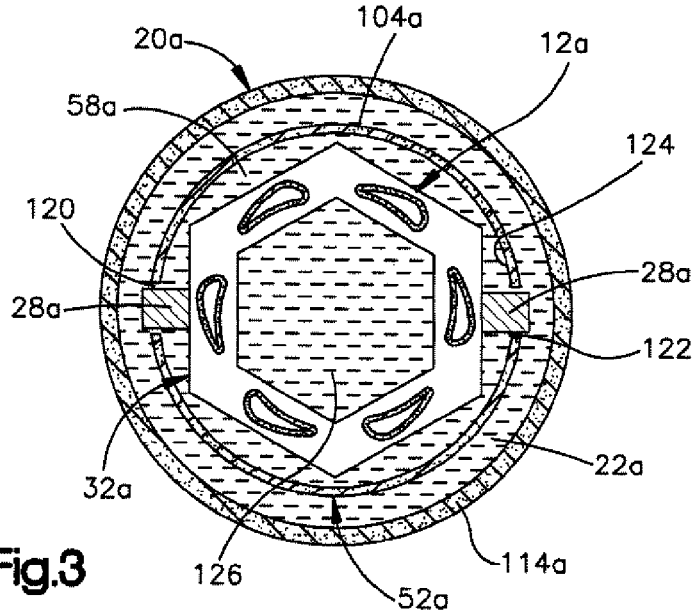
FIG. 3 is a schematic plan view, generally similar to FIG. 2 except on a reduced scale, illustrating the relationship of a tank which holds a body or bath of molten metal and a container in which a portion of the mold and its support structure are disposed.

Embodiment OF FIG. 3

In the embodiment of the invention illustrated in FIGS. 1 and 2, the container 52 has a generally X-shaped cross section (FIG. 2) throughout its vertical extent. In addition, the sidewall 104 of the container 52 is imperforate. In the embodiment of the invention illustrated in FIG. 3, the sidewall of the container has a generally cylindrical configuration and has a pair of slots which extend through the sidewall. Since the embodiment of the invention in FIG. 3 is generally similar to the body of the invention illustrated in FIGS. 1 and 2, similar numerals will be utilized to designate similar components, the suffix letter "a" being added to the numerals of FIG. 3 to avoid confusion.

A mold structure 12*a* is disposed on a support structure 32*a* (FIG. 2). The support structure 32*a* can be raised and lowered relative to a bath or body 22*a* of molten (liquid) metal in the manner previously described in conjunction with the embodiment of the invention illustrated in FIGS. 1 and 2. A furnace assembly, not shown, is disposed above the body 22*a* of molten metal and a tank 20*a* which holds the body of molten metal. The furnace assembly above the tank 20*a* has the same construction as the furnace assembly 16 of FIG. 1.

The support structure 32*a* is connected with a pair of upright support rods 28*a* which are disposed in slots 120 and 122 formed in a cylindrical sidewall 104*a* of a container 52*a*. The slots 120 and 122 are straight and extend vertically downward from a circular opening corresponding to the opening 74 of FIG. 1, at the upper end of the container 52. The slots 120 and 122 extend downwardly along the cylindrical side all 104*a* of the container 52*a* to a location disposed a short distance above the lower end of the container 52*a*. This allows the support structure 32*a* to be lowered in a cylindrical chamber 124 formed by the container 52*a* to a location adjacent to the lower end of the container 52*a*.

The lower end of the container 52*a* is disposed a short distance above a bottom wall of the tank 20*a* in the same manner as is illustrated schematically in FIG. 1 for the container 52. The container 52*a* is submerged in the body 22*a* of molten metal.

The container 52*a* is supported by suitable brackets (not shown) which extend between a cylindrical sidewall 114*a* of the tank 20*a* and the cylindrical sidewall 104*a* of the container 52*a*. These brackets may extend over the upper end of the sidewall 114*a* of the tank 20*a*. Alternatively, the support brackets interconnecting the tank 20*a* and container 52*a* may be connected to the tank at a location below the upper end of the tank.

In the embodiment of the invention illustrated in FIG. 1, the container 52 is provided with a bottom wall 108. The container 52*a* does not have a bottom wall. Thus, the container 52*a* has an open circular upper end and an open circular lower end. The container 52*a* has a cylindrical configuration throughout the axial extent of the container. Of course, the container 52*a* may have a different configuration if desired.

The mold support structure 32*a* has a polygonal configuration, as viewed in FIG. 3. Although the illustrated support structure 32*a* has six support sections, the mold support structure may have a greater or lesser number of support sections if desired. The mold structure 12*a* has a base with a polygonal configuration which corresponds to the polygonal configuration of the mold support structure 32*a*. The mold support structure 32*a* and mold structure 12*a* have the same construction and cooperate in the same manner as is disclosed in the aforementioned U.S. patent application Ser. No. 12/145,033 filed Jun. 24, 2008 by Robert M. Garlock and entitled Method of Casting metal Articles.

The mold support structure 32*a* has an open central portion 126. The open central portion 126 tends to minimize the amount of molten metal which is displaced as the mold support structure 32*a* and mold structure 12*a* are lowered into the submerged container 52*a*. In addition, the open central portion 126 of the mold support structure 32*a* facilitates an upward flow of molten metal 58*a* through the opening at the upper end of the container 52*a* as the mold structure 12*a* and support structure 32*a* are lowered into the container.

It should be understood that the body 22*a* of molten metal completely encloses the container 52*a*. A portion of the body 22*a* of molten metal is disposed above the container 52*a*. Another portion of the body 22*a* is disposed below the container 52*a*.

Figure 4:
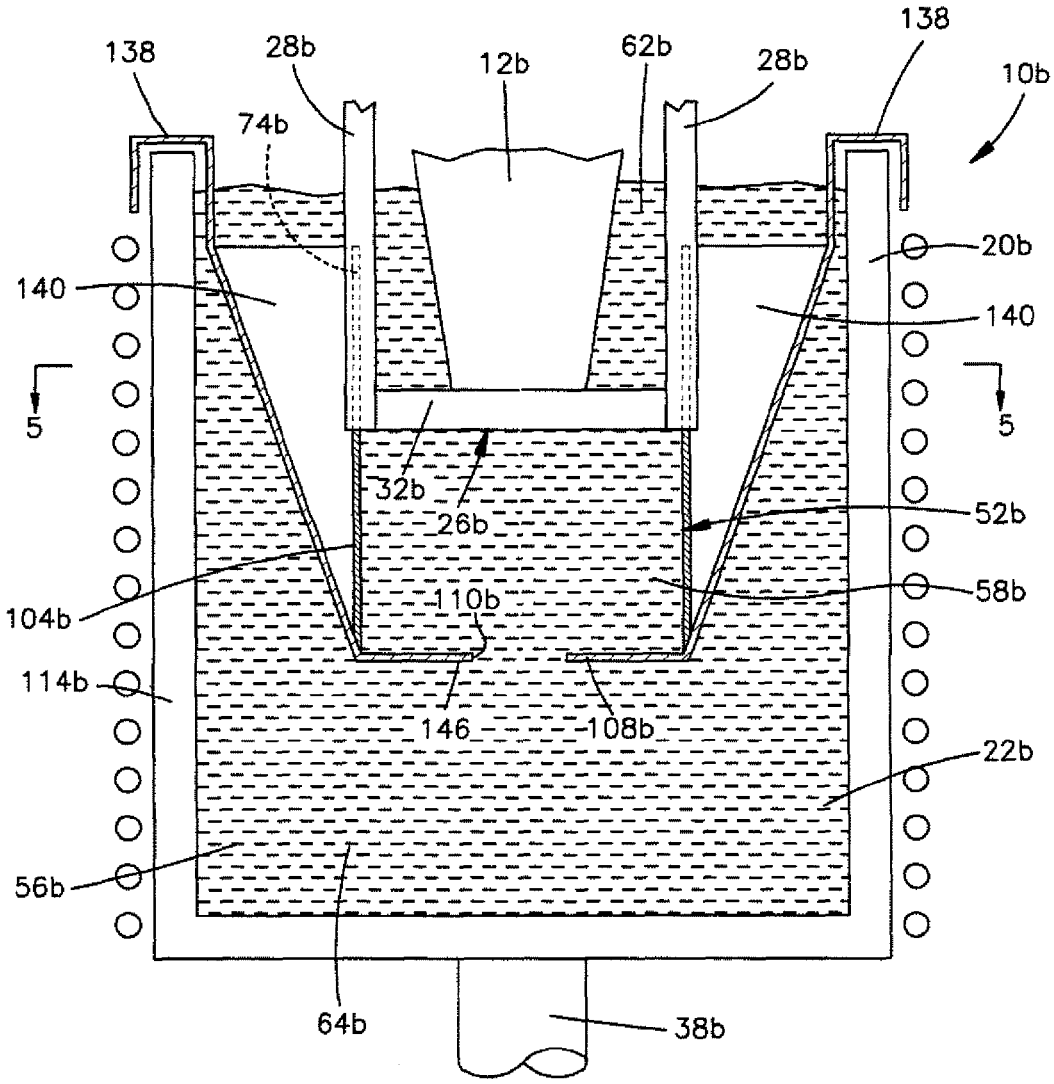
FIG. 4 is a schematic illustration depicting the construction of another embodiment of a container which is disposed in a bath or body of molten metal held by a tank.
Figure 5:
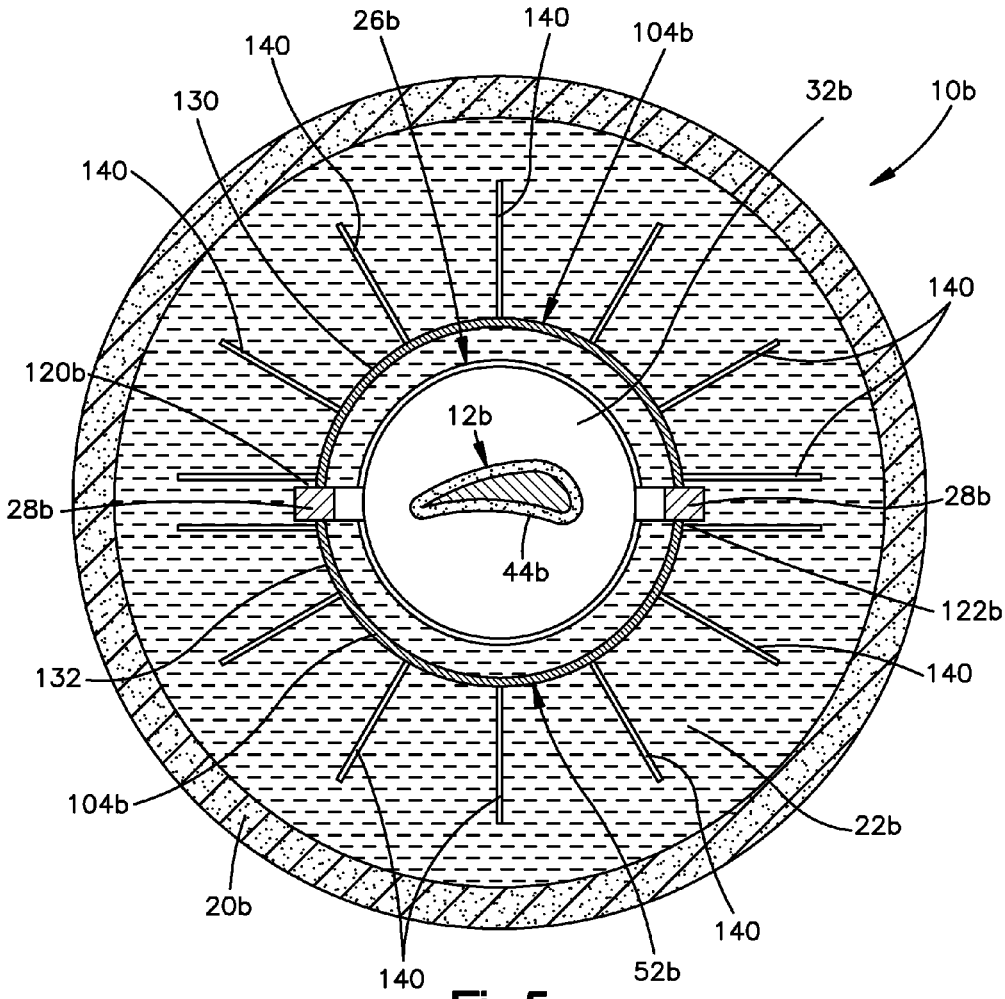
FIG. 5 is a schematic plan view, taken generally along the line 5-5 of FIG. 4, further illustrating the relationship of the container to a support structure for the mold.
Figure 6:
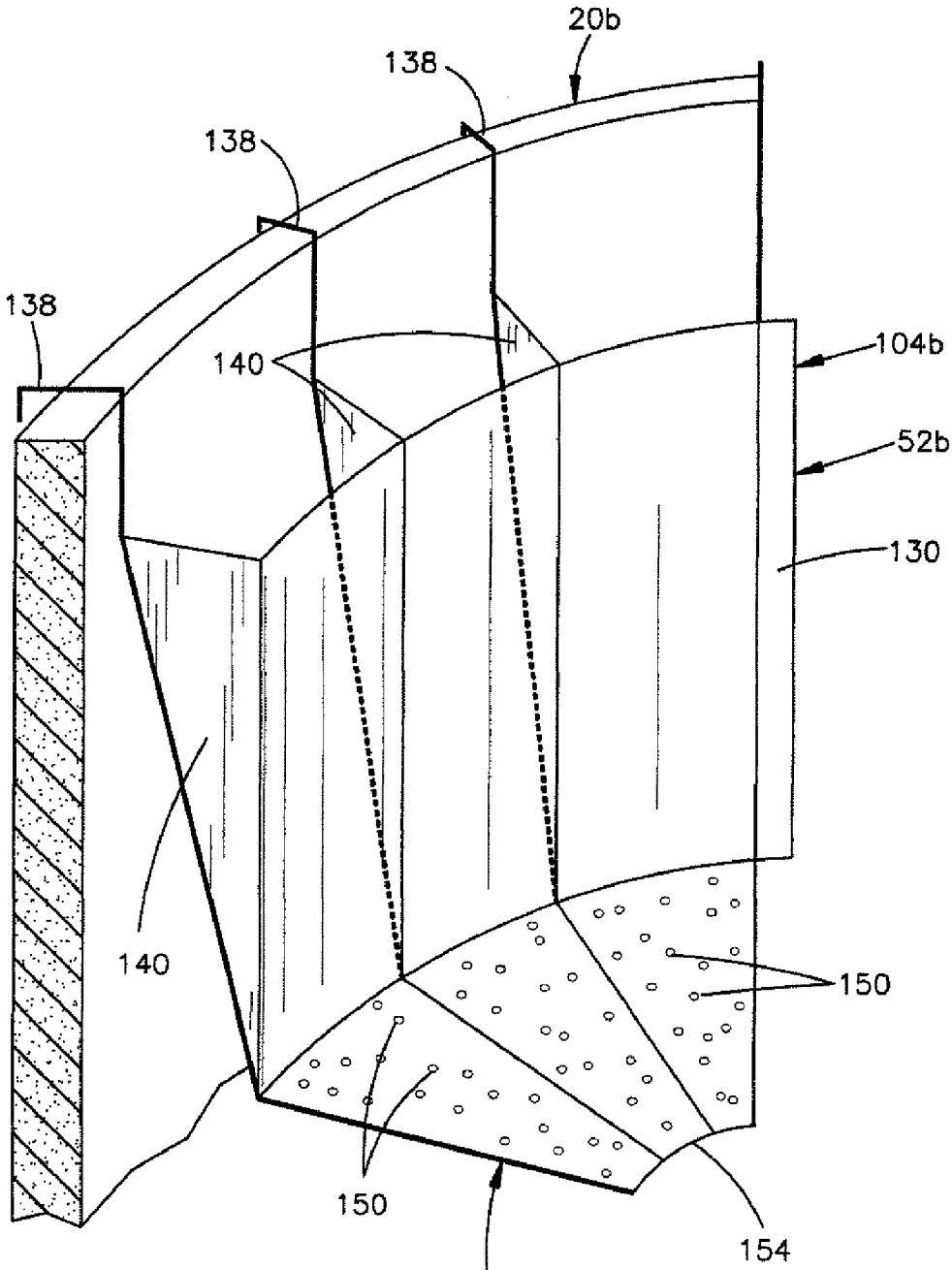
FIG. 6 is a fragmentary schematic pictorial illustration further depicting the structure of the container of FIGS. 4 and 5.

Embodiment OF FIGS. 4-6

In the embodiments of the invention illustrated in FIGS. 1-3, the containers 52 and 52*a* have a unitary structure. Thus, the container 52 of FIGS. 1 and 2 is a unitary structure formed by a bottom wall 108 which is fixedly connected to a sidewall 104 (FIG. 1). The container 52*a* of FIG. 3 is a one piece structure having slots 120 and 122 in the sidewall 104*a*. In the embodiment of the invention illustrated in FIGS. 4-6, the container is formed by separate segments which are interconnected and supported on a tank which holds the bath or body of molten metal. Since the embodiment of the invention illustrated in FIGS. 4-6 is generally similar to the embodiments of the invention illustrated in FIGS. 1-3, similar numerals will be utilized to designate similar components, the suffix letter "b" being associated with the numerals of FIGS. 4-6 to avoid confusion.

A casting apparatus 10*b* (FIG. 4) includes a furnace assembly (not shown but corresponding to the furnace assembly 16 of FIG. 1) in which a first molten metal is poured into a ceramic mold structure 12*b* in a known manner. Directly beneath the furnace assembly is a tank 20*b* which holds a bath or body 22*b* of a second molten (liquid) metal. The casting apparatus 10*b* is enclosed by a suitable housing (not shown) which is connected with a source of vacuum or low pressure. The housing is also connected with a source of an inert gas.

The mold 12*b* is supported for movement to and from the furnace assembly and for movement to and from the body 22*b* of molten metal by a framework 26*b*. The metal framework 26*b* includes a plurality of parallel support rods 28*b* and a mold support structure 32*b*. The support structure 32*b* functions as a chill plate and has a generally circular configuration. The support rods 28*b* are fixedly connected to the support structure 32*b* and extend radially outward from the support structure.

The support rods 28*b* are connected with an upper drive assembly (not shown but corresponding to the drive assembly 34 of FIG. 1). The upper drive assembly is operable to raise and lower the framework 26*b* relative to the furnace assembly and the tank 20*b* holding the body 22*b* of molten metal. A lower drive assembly 38*b* (FIG. 4) is connected with the tank 20*b* which holds the body 22*b* of molten metal. The lower drive assembly 38*b* is operable to raise and lower the tank 20*b* relative to the furnace assembly.

In accordance with one of the features of the invention, a container 52*b* (FIG. 4) is submerged in the tank 20*b*. A first portion 56*b* of the body 22*b* of molten metal is disposed in the tank 20*b* outside of the container 52*b*. A second portion 58*b* of the bath or body 22*b* of molten metal is disposed within the container 52*b*. The container 52*b* isolates the second portion 58*b* of the bath or body 22*b* of molten metal from convective currents which are established in the bath. This results in the second portion 58*b* of the bath or body 22*b* of molten metal being substantially stagnate and isolated from the circulatory currents established in the relatively large portion 56*b* of the bath or body 22*b* of molten metal.

Since the portion 58*b* of the body 22*b* of molten metal in the container 52*b* is more or less stagnate, it is heated to a higher temperature than the portion 56*b* of the bath or body 22*b* of molten metal. The relatively high temperature of the portion 58*b* of the bath or body 22*b* of molten metal in the container 52*b* results in a relatively low rate of heat transfer from the portion of the mold structure 12*b* disposed within the container 52*b*. The relatively low rate of heat transfer from the portion of the mold structure 12*b* disposed within the container 52*b* minimizes stress formation in a portion of a cast article in the mold structure 12*b* after initial solidification of metal forming a portion of the article disposed in the container 52*b*.

When the mold structure 12*b* is to be utilized to cast one or more metal articles, a molten nickel-chrome super alloy is poured into the mold structure 12*b* while the mold structure is disposed above the tank 20*b* in a furnace assembly, corresponding to the furnace assembly 16 of Fig, 1. Once the mold structure 12*b* has been filled with molten metal, an upper drive assembly, corresponding to the drive assembly 34 of FIG. 1, is operated to lower the framework 26*b* . As the framework 26*b* and mold structure 12*b* are lowered into the bath or body 22*b* (FIG. 4) of molten metal, the mold support structure 32*b* and the lower end portion of the mold structure 12*b* move into an upper portion 62*b* of the bath or body 22*b* of molten metal. The upper portion 62*b* of the bath or body 22*b* of molten metal is disposed above the submerged container 52*b* . As the lower portion of the mold structure 12*b* enters the upper portion 62*b* of the bath or body 22*b* of molten metal, the molten metal in the lower portion of the mold structure 12*b* begins to solidify.

As the mold structure 12*b* is moved further downward through the upper portion 62*b* of the bath or body 22*b* of molten metal, the lower portion of the mold structure 12*b*, containing the almost solidified nickel-chrome super alloy metal, is moved into the container 52*b*. As the lower portion of the mold structure 12*b* enters the container 52*b*, the lower portion of the mold structure is enclosed by the second portion 58*b* of the bath or body 22*b* of molten metal.

When the mold structure 12*b* and mold support framework 26*b* are moved into the submerged container 52*b*, a portion of the molten metal 58*b* is displaced from the container. A portion of the displaced molten metal 58*b* flows upward along the framework 26*b* and mold structure 12*b*. This molten metal flows through a circular opening 74*b* (FIG. 4) at the upper end of the container 52*b*.

Another portion of the displaced molten metal 58*b* flows downward along the sidewall 104*b* of the container. This molten metal flows across a bottom wall 108*b* (FIG. 4) of the container to opening 110*b*. This displaced molten metal flows through the opening 110*b* into the portion 56*b* of the body 22*b* of molten metal disposed outside the container 52*b*.

By displacing molten metal 58*b* from the container 52*b* with the mold support framework 26*b* and mold structure 12*b*, the volume of molten metal in the container is reduced. Reducing the volume of molten metal 58*b* in the container 52*b* facilitates heating the molten metal in the container with heat transmitted from the mold structure 12*b*. As this occurs, the temperature differential between the mold structure 12*b* and the molten metal 58*b* in the container is reduced. This results in a reduction in the rate at which heat is transmitted from the mold structure 12*b*. Reducing the rate at which heat is transmitted from the mold structure 12*b* tends to reduce stress, caused by differential thermal construction, in the articles cast in the mold structure.

Since the container 52*b* retains the second portion 58*b* of the bath or body 22*b* of molten metal against movement, the heat transferred from the lower portion of the mold structure 12*b* heats the second portion 58*b* of the bath or body 22*b* of molten metal. This results in a reduction in the rate of heat transfer from the lower portion of the mold structure 12*b* disposed in the container 52*b* to the bath or body 22*b* of molten metal. Of course, reducing the rate of heat transfer from the portion of the mold structure 12*b* enclosed by the container 52*b* avoids the formation of stress during casting of the metal article in the mold structure 12*b* due to differential thermal contraction.

As the mold structure 12*b* continues to be lowered into the tank 20*b*, solidification of molten metal in an article mold 44*b* (FIG. 5) is initiated. At this time, there is a relatively high rate of heat transfer from the mold structure to the upper portion 62*b* of the bath or body 22*b* of molten metal. However, the portion 58*b* of the bath or body 22*b* of molten metal disposed in the container 52*b* is at a higher temperature than the upper portion 62*b* of the bath or body of molten metal. Therefore, as the mold structure 12*b* moves downward into the container 52*b*, the rate of heat transfer from the mold structure is reduced.

The container 52*b* includes a sidewall 104*b* (FIG. 5) which is formed as two separate sections 130 and 132. The generally semicircular sections 130 and 132 of the sidewall 104*b* are separated from each other by slots 120*b* and 122*b*. The support rods 28*b* of the framework 26*b* are received in the slots 120*b* and 122*b*.

The slots 120*b* and 122*b* extend between opposite ends of the container 52*b*. Thus, both of the slots 120*b* and 122*b* extend throughout the entire axial extent of the sidewall 104*b* of the container 52*b*. In the embodiment of the container 52*a* illustrated in FIG. 3, the slots 120 and 122 extend from the upper end of the container to a location adjacent to but spaced from, the lower end of the container. This results in a connection piece spanning the lower ends of the slots 120 and 122 in the embodiment of FIG. 3. However, in the embodiment of FIG. 5, the slots 120*b* and 122*b* extend between opposite ends of the container and are not spanned by connector portions of the sidewall 104*b*.

The section 130 (FIG. 6) of the sidewall 104*b* of the container 52*b* is suspended from the sidewall 114*b* of the tank 20*b*. Hooks 138 are connected with the section 130 of the sidewall 104*b* of the container 52*b* by brackets 140. Although only the section 130 of the sidewall 104*b* is illustrated in FIG. 6, the section 132 of the sidewall is suspended in the same manner as the section 130.

The brackets 140 extend from the sidewall 114*b* of the tank 20*b* to the section 130 of the sidewall 104*b* of the container 52*b* in the manner illustrated schematically in FIG. 6. The brackets 140 hold the section 130 of the container sidewall 104*b* in a spaced apart relationship with the tank sidewall 114*b* to enable convective currents to circulate in the body 22*b* of metal. Convective currents in the body 22*b* (FIG. 5) of molten metal circulate between the upper portion 62*b* of the body of molten metal and the lower portion 64*b* (FIG. 4) of the body 22*b* of molten metal. This enables the upper portion 62*b* of the bath or body of molten metal to be maintained at a relatively low temperature to initiate solidification of molten metal in the mold structure 12*b* as it is lowered into the container 52*b*.

The relatively hot portion 58*b* of the body 22*b* of molten metal in the container 52*b* is effective to reduce the rate of heat transfer from the mold structure 12*b* as the mold structure moves out of the upper portion 62*b* of the body 22*b* of molten metal into the portion 58*b* of the body of molten metal disposed within the container 52*b*. Reducing the rate of heat transfer from the portion of the mold structure 12*b* in the container 52*b* reduces the tendency for stresses to be induced in articles cast in the mold structure 12*b*.

In the embodiment of the container 52*b* illustrated in FIGS. 4-6, the container is provided with bottom wall sections which extend radially inwardly from the sidewall sections 130 and 132. Thus, a bottom wall section 146 (FIGS. 4 and 6) extends radially inwardly from the sidewall section 130. Although only the bottom wall section 146 extending inwardly from the sidewall section 130 is illustrated in FIGS. 4 and 6, it should be understood that a bottom wall section having the same construction as the bottom wall section 146 extends inwardly from the sidewall section 132. The two bottom wall sections extending radially inward from the sidewall sections 130 and 132 are separated by the slots 120*b* and 122*b* (FIG. 5) disposed between the sidewall sections 130 and 132.

A plurality of relatively small openings 150 (FIG. 6) are formed in the bottom wall section 146 (FIG. 6). Similar openings are formed in the bottom wall section extending from the sidewall section 132. The two bottom wall sections extending from the sidewall sections 130 and 132 have arcuate edge portions 154 (FIG. 6) which cooperate to form a circular opening at the bottom of the container 52*b*. The slots 120*b* and 122*b* intersect the opening at the bottom of the container 52*b*.

The opening formed by the circular edges 154 (FIG. 6) at the bottom of the container 52*b* is coaxial with the circular opening at the upper end of the container 52*b*. Although the bottom wall section 146 of the container 52*b* has been provided with small openings 150, the small openings may be eliminated. Alternatively, the central opening formed by the arcuate edges 154 may be eliminated.

Conclusion

In view of the foregoing description, it is apparent that the present invention provides a new and improved method of casting metal articles. The method includes moving a mold 12 containing a first molten metal downward into a body or bath 22 of a second molten metal. As the mold 12 enters the body or bath 22 of molten metal, heat is transferred at a first rate from the mold to a first portion 62 of the body 22 of molten metal. As the mold moves downward into the body 22 of molten metal, the mold enters a container 52 in which a portion 58 of the body of molten metal is disposed.

The container 52 is effective to retard movement of molten metal in the body or bath 22 of molten metal relative to the mold 12. This results in the temperature of the portion 58 of the body or bath 22 of molten metal disposed in the container 52 increasing to thereby retard transfer of heat from the portion of the mold 12 disposed in the container to the body or bath of molten metal. Retarding the transfer of heat from the portion of the mold 12 disposed in the container 52 to the body or bath 22 of molten metal minimizes stress formation in metal solidified in the mold.

The present invention has a plurality of different features which are advantageously utilized together in the manner disclosed herein. However, it is contemplated that the features may be utilized separately and/or in combination with features from the prior art.

Having described the invention, the following is claimed:

1. A method of casting metal articles, said method comprising the steps of pouring a first molten metal into a mold in a furnace while the first molten metal is at a first temperature, providing a tank which holds a body of a second molten metal which is at a second temperature which is less than the first temperature, a container being submerged in the body of a second molten metal and being filled with the second molten metal, moving a lower portion of the mold containing the first molten metal downward from the furnace into an upper portion of the body of a second molten metal, transmitting heat at a first rate from the lower portion of the mold to the upper portion of the body of a second molten metal with the mold disposed above the container, moving the mold downwardly to move the lower portion of the mold downward into the container through an opening in an upper portion of the container, flowing a portion of the second molten metal disposed in the container upward through the opening in the upper portion of the container as the mold moves downward into the container, said step of flowing molten metal upward through the opening in the upper portion of the container includes reducing the quantity of the second molten metal in the container, heating the reduced quantity of the second molten metal in the container to a temperature which is greater than a temperature of the second molten metal in the upper portion of the body of a second molten metal disposed above the container, said step of heating the reduced quantity of the second molten metal in the container includes transmitting heat from a portion of the mold disposed in the container to the reduced volume of the second molten metal in the container, and, thereafter, transmitting heat from the portion of the mold disposed in the container to the reduced volume of the second molten metal in the container at a rate which is less than the first rate of heat transfer.

2. A method as set forth in claim 1 further including the step of flowing a portion of the second molten metal disposed in the container downward through an opening in the lower portion of the container as the mold moves downward in the container.

3. A method as set forth in claim 1 further including the step of pumping molten metal from a lower portion of the body of a second molten metal to the upper portion of the body of a second molten metal, said step of pumping molten metal includes conducting a flow of molten metal through a conduit which is disposed outside the container and extends from a lower portion of the body of a second molten metal to the upper portion of the body of a second molten metal.

4. A method of casting metal articles, said method comprising the steps of pouring a first molten metal into a mold in a furnace while the first molten metal is at a first temperature, providing a tank which holds a body of a second molten metal which is at a second temperature which is less than the first temperature, a container being submerged in the body of a second molten metal and being filled with the second molten metal, moving a lower portion of the mold containing the first molten metal downward from the furnace into an upper portion of the body of a second molten metal, transmitting heat at a first rate from the lower portion of the mold to the upper portion of the body of a second molten metal with the mold disposed above the container, moving the mold downwardly to move the lower portion of the mold downward into the container through a first opening in an upper portion of the container, flowing a portion of the second molten metal disposed in the container upward through the first opening in the upper portion of the container as the mold moves downward into the container, flowing a portion of the second molten metal disposed in the container downward through a second opening in the lower portion of the container, the second opening being smaller than the first opening, said step of moving the mold downwardly includes restricting a downward flow of molten metal at the relatively small second opening to retard downward movement of molten metal from the container, said step of moving the mold downward into the container through the first opening includes supporting the mold on a support structure with portions of the support structure extending along slots in the container, heating the second molten metal in the container to a temperature which is greater than a temperature of the second molten metal in the upper portion of the body of a second molten metal disposed above the container, said step of heating the second molten metal in the container includes transmitting heat from a portion of the mold disposed in the container to the second molten metal in the container, and, thereafter, transmitting heat from the portion of the mold disposed in the container to the second molten metal in the container at a rate which is less than the first rate of heat transfer.

5. A method as set forth in claim 4 further including the step of pumping molten metal through a conduit from a portion of the body of molten metal disposed below the container to a portion of the body of molten metal disposed above the container.

6. A method as set forth in claim 4 further including the step of supporting the container with a plurality of hangers which extend over an upper portion of the tank.

7. A method of casting metal articles, said method comprising the steps of moving a mold downward from a furnace into a body of molten metal, transferring heat at a first rate from the mold to a first portion of the body of molten metal as the mold moves downward into the body of molten metal, transferring heat at a second rate from the mold to a second portion of the body of molten metal as the mold moves downward into the body of molten metal, said second portion of the body of molten metal being disposed below said first portion of the body of molten metal, said second rate of heat transfer being less than said first rate of heat transfer, and retarding movement of molten metal which is disposed in the second portion of the body of molten metal and is disposed in engagement with the mold without significantly retarding movement of other molten metal disposed in the first portion of the body of molten metal.

8. A method as set forth in claim 7 wherein said step of retarding movement of molten metal which is disposed in the second portion of the body of molten metal includes providing a container which is disposed in the second portion of the body of molten metal and which contains molten metal forming at least part of the second portion of the body of molten metal, said step of moving the mold downward from the furnace into a body of molten metal includes moving a portion of the mold into the container.

9. A method as set forth in claim 7 wherein said step of retarding movement of molten metal which is disposed in the second portion of the body of molten metal includes providing a container having openings at opposite end portions of the container, said step of moving the mold downward from the furnace into a body of molten metal includes sequentially moving at least a leading portion of the mold through an opening disposed at an upper end portion of the container and moving the leading portion of the mold through a central portion of the container which extends around the mold and is filled with molten metal of the second portion of the body of molten metal.

10. A method of casting metal articles, said method comprising the steps of moving a mold downward from a furnace into a body of molten metal, transferring heat at a first rate from the mold to a first portion of the body of molten metal as the mold moves downward into the body of molten metal, and transferring heat at a second rate from the mold to a second portion of the body of molten metal as the mold moves downward into the body of molten metal, said second portion of the body of molten metal being disposed below said first portion of the body of molten metal, said second rate of heat transfer being less than said first rate of heat transfer, providing a container which is disposed in the body of molten metal and contains a portion of the body of molten metal, said step of moving the mold downward into the body of molten metal includes moving at least a portion of the mold and at least a portion of a mold support downward into the container, and retarding movement of the portion of the body of molten metal which is disposed in the container relative to the mold with a sidewall of the container.

11. A method as set forth in claim 10 further including the step of conducting a flow of molten metal through an opening disposed at a lower end portion of the container as the mold and mold support are moved downward into the container.

12. A method as set forth in claim 10 further including the step of conducting a flow of molten metal through an opening formed in the mold support as the mold and mold support are moved downward in the container.

13. A method as set forth in claim 10 further including the step of pumping molten metal from a portion of the body of molten metal disposed below the container to a portion of the body of molten metal disposed above the container, said step of pumping molten metal includes conducting a flow of molten metal through a conduit which is disposed outside the container and extends from a lower portion of the body of molten metal to the first portion of the body of molten metal.

14. A method as set forth in claim 10 wherein the mold support includes a plurality of support sections which extend outwardly from a central portion of the mold support, said step of moving the mold and mold support downward into the container includes conducting a flow of molten metal through spaces disposed between the support sections of the mold support and a sidewall of the container.

15. A method as set forth in claim 10 further including the step of supporting the container with a plurality of hangers which extend over an upper portion of a tank which holds the body of molten metal.

16. A method of casting metal articles, said method comprising the steps of initiating solidification of molten metal in a first portion of a mold by lowering the mold to a first depth in a body of molten metal, initiating solidification of molten metal in portions of the mold disposed above the first portion of the mold by continuing to lower the mold into the body of molten metal, and minimizing stress formation in metal solidified in the mold by at least partially enclosing a portion of the mold with a container which extends between the first depth in the body of molten metal and a second depth in the body of molten metal, said second depth being lower than the first depth, the container includes a sidewall having a slot which extends downward from the first depth in the body of molten metal, said step of continuing to lower the mold into the body of molten metal includes moving a portion of a support for the mold along the slot in the sidewall of the container.

17. A method of casting metal articles, said method comprising the steps of moving a mold downward from a furnace into a body of molten metal, transferring heat at a first rate from the mold to a first portion of the body of molten metal as the mold moves downward into the body of molten metal, and transferring heat at a second rate from the mold to a second portion of the body of molten metal as the mold moves downward into the body of molten metal, said second portion of the body of molten metal being disposed below said first portion of the body of molten metal, said second rate of heat transfer being less than said first rate of heat transfer, said step of transferring heat at a first rate from the mold to a first portion of the body of molten metal includes initiating solidification of molten metal in a first portion of the mold as the mold is lowered to a first depth in a body of molten metal, said step of transferring heat at a second rate from the mold to a second portion of the body of molten metal includes initiating solidification of molten metal in portions of the mold disposed above the first portion of the mold, and minimizing stress formation in metal solidified in the mold by at least partially enclosing a portion of the mold with a container which extends between the first depth in the body of molten metal and a second depth in the body of molten metal, said second depth being lower than the first depth, wherein the container includes a sidewall having a slot which extends downward from the first depth in the body of molten metal, said step of moving the mold downward into the body of molten metal includes moving a portion of a support for the mold along the slot in the sidewall of the container.

18. A method of casting metal articles, said method comprising the steps of moving a mold downward from a furnace into a body of molten metal, transferring heat at a first rate from the mold to a first portion of the body of molten metal as the mold moves downward into the body of molten metal, and transferring heat at a second rate from the mold to a second portion of the body of molten metal as the mold moves downward into the body of molten metal, said second portion of the body of molten metal being disposed below said first portion of the body of molten metal, said second rate of heat transfer being less than said first rate of heat transfer, said step of transferring heat at a first rate from the mold to a first portion of the body of molten metal includes initiating solidification of molten metal in a first portion of the mold as the mold is lowered to a first depth in a body of molten metal, said step of transferring heat at a second rate from the mold to a second portion of the body of molten metal includes initiating solidification of molten metal in portions of the mold disposed above the first portion of the mold, and minimizing stress formation in metal solidified in the mold by at least partially enclosing a portion of the mold with a container which extends between the first depth in the body of molten metal and a second depth in the body of molten metal, said second depth being lower than the first depth, the body of molten metal is held in a tank, said method further including the step of supporting a container in the body of molten metal by connecting the container with a portion of the tank disposed above an upper surface of the body of molten metal.

19. A method of casting metal articles, said method comprising the steps of moving a mold downward from a furnace into a body of molten metal, transferring heat at a first rate from the mold to a first portion of the body of molten metal as the mold moves downward into the body of molten metal, transferring heat at a second rate from the mold to a second portion of the body of molten metal as the mold moves downward into the body of molten metal, said second portion of the body of molten metal being disposed below said first portion of the body of molten metal, said second rate of heat transfer being less than said first rate of heat transfer, pouring molten metal into the mold while the mold is in the furnace and while the molten metal poured into the mold is at a first temperature, providing a tank which holds the body of molten metal with the molten metal in the tank at a second temperature which is less than the first temperature, a container being submerged in the body of molten metal in the tank and being filled with the molten metal of the body of molten metal in the tank, moving a lower portion of the mold containing molten metal downward from the furnace into an upper portion of the body of molten metal in the tank, transmitting heat at a first rate from a lower portion of the mold to the upper portion of the body of molten metal in the tank with a portion of the mold disposed above the container, moving a lower portion of the mold downward into the container through an opening in an upper portion of the container, flowing a portion of the molten metal disposed in the container upward through the opening in the upper portion of the container as the mold moves downward into the container, said step of flowing molten metal upward through the opening in the upper portion of the container includes reducing the quantity of the molten metal in the container, heating the reduced quantity of the molten metal in the container to a temperature which is greater than a temperature of the molten metal in the upper portion of the body of molten metal disposed above the container, said step of heating the reduced quantity of the molten metal in the container includes transmitting heat from a portion of the mold disposed in the container to the reduced volume of the molten metal in the container, and, thereafter, transmitting heat from the portion of the mold disposed in the container to the reduced volume of the molten metal in the container at a rate which is less than the first rate of heat transfer.

20. A method as set forth in claim 19 further including the step of flowing a portion of the molten metal disposed in the container downward through an opening in the lower portion of the container as the mold moves downward in the container.

21. A method as set forth in claim 19 further including the step of pumping molten metal through a conduit from a lower portion of the body of molten metal to the upper portion of the body of molten metal.

* * * * *